US006390792B1

(12) United States Patent
Tarng et al.

(10) Patent No.: US 6,390,792 B1
(45) Date of Patent: May 21, 2002

(54) VENTING PASSAGE FOR ISOLATION BLOCK OF SCROLL COMPRESSOR AND CHECK VALVE FOR THE SAME

(75) Inventors: Guang-Der Tarng, Hsin Chu Hsien; Lung-Tsai Chang, Hsin Chu, both of (TW)

(73) Assignee: Rechi Precision Co., Ltd., Tao Yuan Hsien (TW)

( * ) Notice: Subject to any disclaimer, the term of this patent is extended or adjusted under 35 U.S.C. 154(b) by 0 days.

(21) Appl. No.: 09/766,628

(22) Filed: Jan. 23, 2001

(51) Int. Cl.[7] ..... F01C 1/02
(52) U.S. Cl. ..... 418/55.1; 418/270
(58) Field of Search ..... 418/55.1, 270

(56) References Cited

U.S. PATENT DOCUMENTS

| | | | | |
|---|---|---|---|---|
| 5,366,359 A | * | 11/1994 | Bookbinder et al. | 418/55.5 |
| 5,487,654 A | * | 1/1996 | Wallis et al. | 418/55.1 |
| 5,494,422 A | * | 2/1996 | Ukai et al. | 418/55.1 |

FOREIGN PATENT DOCUMENTS

| | | | | |
|---|---|---|---|---|
| JP | 03-267591 | * | 11/1991 | 418/55.1 |
| JP | 04-279782 | * | 10/1992 | 418/55.1 |
| JP | 05-149269 | * | 6/1993 | 418/55.1 |
| JP | 05-231351 | * | 9/1993 | 418/55.1 |
| JP | 06-026470 | * | 2/1994 | 418/55.5 |
| JP | 06-173864 | * | 6/1994 | 418/55.5 |

* cited by examiner

*Primary Examiner*—Thomas Denion
*Assistant Examiner*—Theresa Trieu
(74) *Attorney, Agent, or Firm*—Rosenberg, Klein & Lee

(57) ABSTRACT

A venting passage for isolation block of a scroll compressor and a check valve for the same. The compressor mainly comprises a fixed scroll member, an orbit scroll member, and an isolation block. The isolation block has venting passage and the venting passage has a through hole on bottom thereof and communicated with the discharging port of the fixed scroll member. A baffle is provided at top opening of the venting passage to form a muffle room. The venting passage has a floating planar valve. Moreover, the projecting ring has a plurality of venting apertures of window shape on top portion thereof and with even distribution.

5 Claims, 4 Drawing Sheets

VENTING PASSAGE FOR ISOLATION BLOCK OF SCROLL COMPRESSOR AND CHECK VALVE FOR THE SAME

FIELD OF THE INVENTION

The present invention relates to a venting passage for isolation block of a scroll compressor, especially to a venting passage for isolation block of a scroll compressor to enhance venting flow and reduce noise and check valve for the same.

BACKGROUND OF THE INVENTION

FIG. 1 shows a prior art scroll compressor, which comprises an orbit scroll member 110*a*, a fixed scroll member 11*a*, and an isolation block 12*a*. The fixed scroll member 111*a* has a plurality of scroll wraps 110*a* and a discharging port 111*a* at a center thereof. The orbit scroll member 10*a* also has a plurality of scroll wraps 100*a* fitted with the scroll wraps 110*a* of the fixed scroll member 111*a* to form a plurality of compression chambers between the scroll wraps 100*a* of the orbit scroll member 10*a* and the scroll wraps 110*a* of the fixed scroll member 11*a*. The orbit scroll member 10*a* is driven by external force to orbit the fixed scroll member 11*a* without revolution, whereby working fluid is introduced into the compression chamber from outside. The working fluid is compressed to a high-pressure state in the compression chamber and discharged through the discharging port 111*a*. The isolation block 12*a* is fixed within a case 1 of the scroll compressor to divide the inner space of the case 1 into a high-pressure chamber 2*a* and a low pressure chamber 3*a*. The isolation block 12*a* has a through hole 122*a* to provide communication between the two chambers 2*a* and 3*a*. The scroll compressor has a plurality of back-pressure chambers 123*a*.

Moreover, the fixed scroll member 11*a* is located within the low-pressure chamber 3*a* and the discharging port 111*a* has a tubular neck 112*a* extended therefrom. The tubular neck 112*a* is coupled to the through hole 122*a* of the isolation block 12*a* and a leak-proof member 124*a* is provided between the tubular neck 112*a* and the through hole 122*a* to prevent the working fluid from leaking into the low-pressure chamber 3*a* from the discharging port 111*a*. When the orbit scroll member 10*a* and the fixed scroll member 11*a* are engaged to each other, the compressed fluid therein is led to the back-pressure chambers 123. Therefore, the compression chamber is tightened in axial direction to prevent the leakage of fluid therein. However, the discharging port 11*a* is generally configured with straight shape and the working fluid is discharged in axial direction. Alternatively, a radial venting hole 125*a* is provided at a flange 127*a* beside the through hole 122*a*. Moreover, a check valve 126*a* is provided in the through hole 122*a*. However, the flow of the working fluid may cause the imbalance of the check valve 126*a* and noise is generated. The radial venting hole 125*a* results a vertical fluid flowing path such that the fluid flow is not smooth and the noise is increased.

SUMMARY OF THE INVENTION

It is the object of the present invention to provide a venting passage for isolation block of a scroll compressor to enhance venting flow and reduce noise and check valve for the same.

To achieve the above object, the present invention provides a venting passage for isolation block of a scroll compressor to enhance venting flow and reduce noise, as well as a check valve for the same. The compressor mainly comprises a fixed scroll member, an orbit scroll member, and an isolation block. The fixed scroll member has a plurality of scroll wraps and a discharging port at a center thereof. The orbit scroll member also has a plurality of scroll wraps fitted with the scroll wraps of the fixed scroll member to form a plurality of compression chambers therebetween. The isolation block has a projecting ring with a venting passage at a center thereof. The venting passage has a through hole on a bottom thereof for communication with the discharging port. A baffle is provided at a top opening of the venting passage, whereby the venting passage forms a muffle room for the air entering therein. The muffle room has a floating planar valve. Moreover, the projecting ring has a plurality of venting apertures of window shape on a top portion thereof, preferably with even distribution. The plurality of venting apertures can be formed by milling machine or integrally formed with the isolation block.

The various objects and advantages of the present invention will be more readily understood from the following detailed description when read in conjunction with the appended drawing, in which:

DETAILED DESCRIPTION OF THE INVENTION

Figure 1:
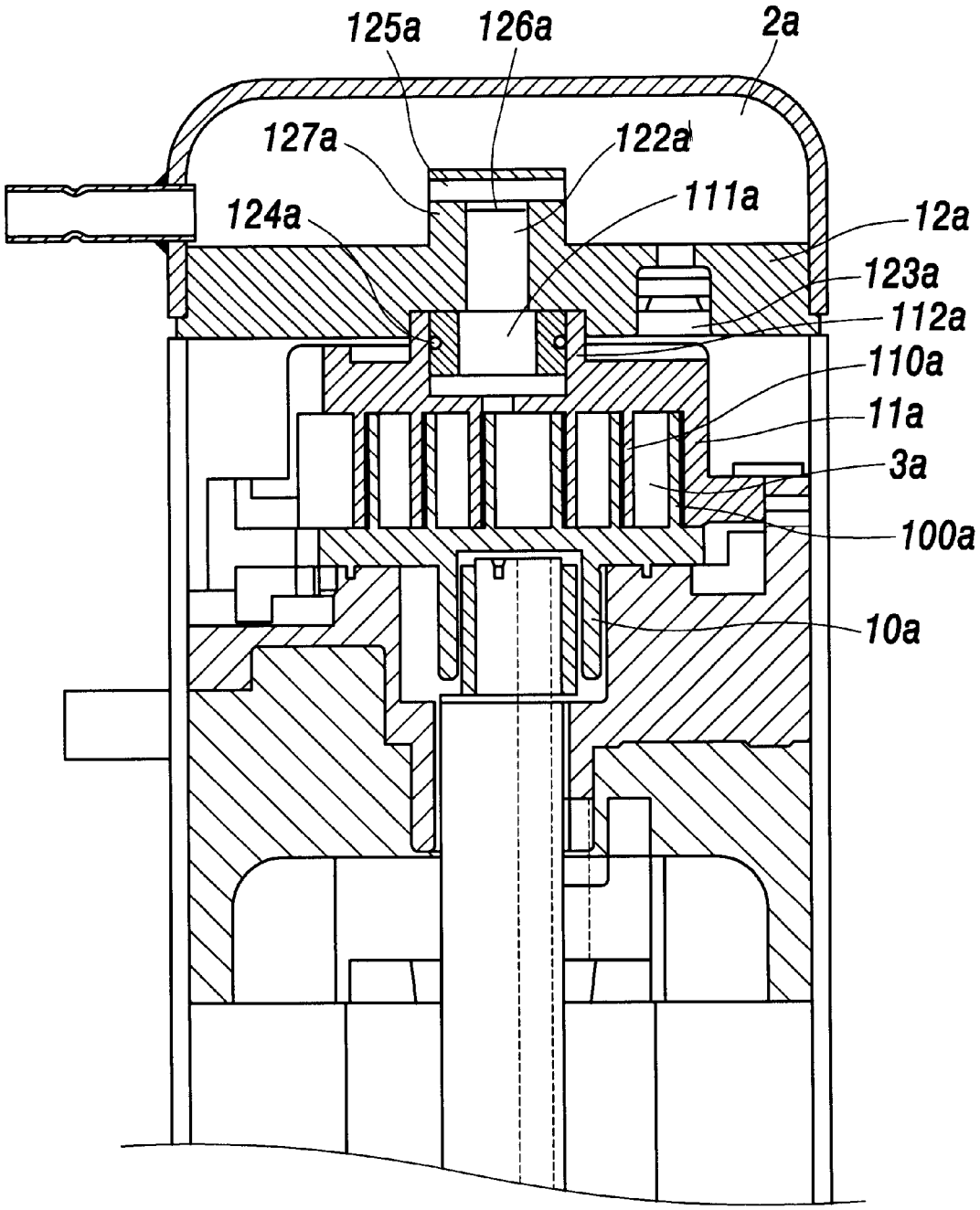
FIG. 1 PRIOR ART
FIG. 1 is a sectional view of a prior art.
Figure 2:
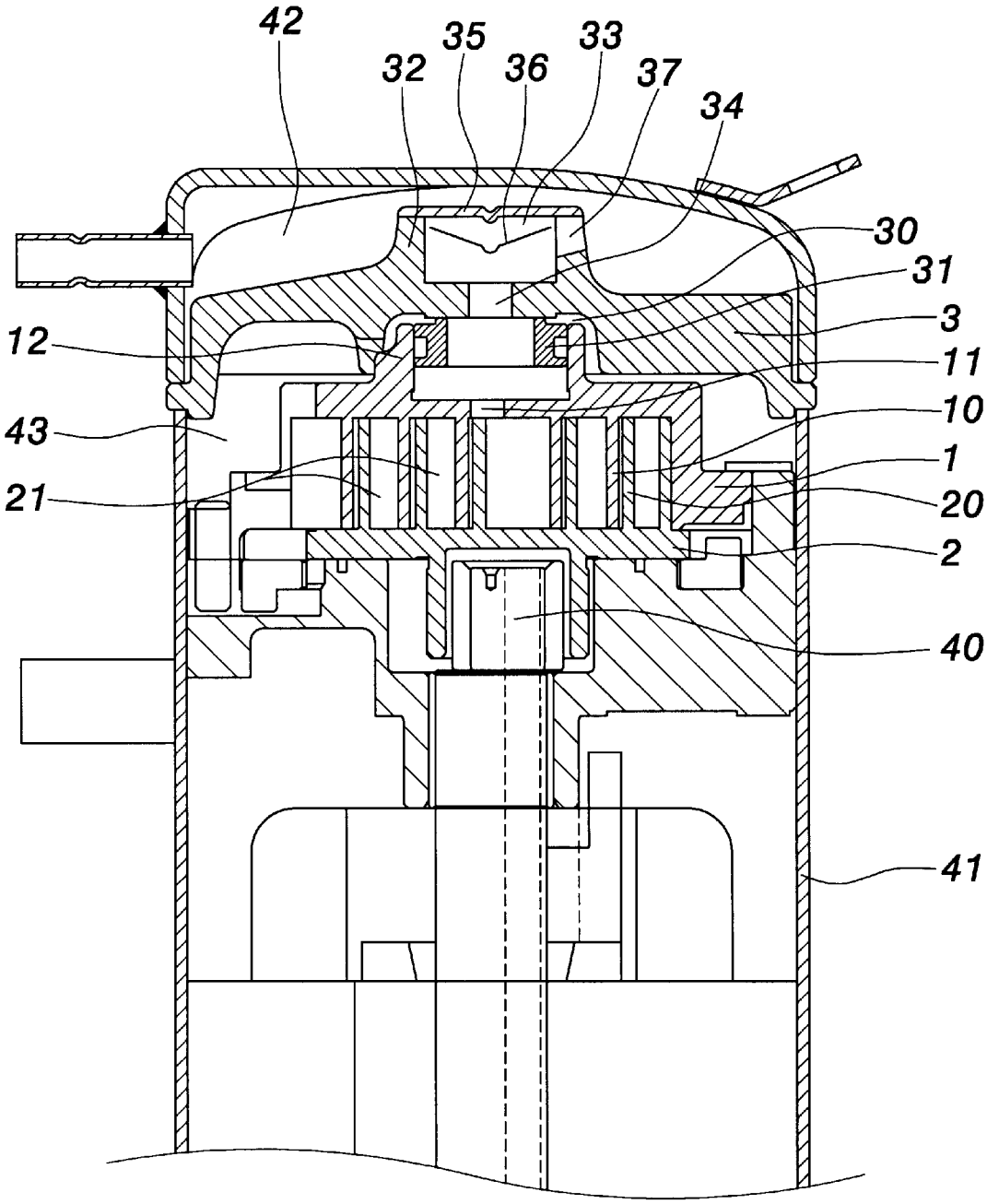
FIG. 2 is a sectional view of the present invention.

FIG. 2 shows a view of a scroll compressor according to the present invention. The compressor mainly comprises a fixed scroll member 1, an orbit scroll member 2, and an isolation block 3. The fixed scroll member 1 has a plurality of scroll wraps 10 and a discharging port 1 at a center thereof. The orbit scroll member 2 also has a plurality of scroll wraps 20 fitted with the scroll wraps 10 of the fixed scroll member 1 to form a plurality of compression chambers 21 therebetween. The orbit scroll member 2 is driven by an eccentric shaft 40 to orbit the fixed scroll member 1 without revolution, whereby working fluid is introduced into the compression chamber 21 from outside. The working fluid is compressed to a high-pressure state in the compression chamber 21 and discharged through the discharging port 11. The isolation block 3 is fixed within a case 41 of the scroll compressor to divide the inner space of the case 41 into a high-pressure chamber 42 and a low-pressure chamber 43. The fixed scroll member 1 is located within the low-pressure chamber 43, and the fixed scroll member 1 has a tubular neck 12 extended therefrom. The tubular neck 12 is coupled to a groove 30 on a bottom of the fixed scroll member 1. A leak-proof member 31 is provided between the tubular neck 12 and the groove 30 to prevent the working fluid form leaking into the low-pressure chamber 43 from the discharging port 11.

Figure 3:
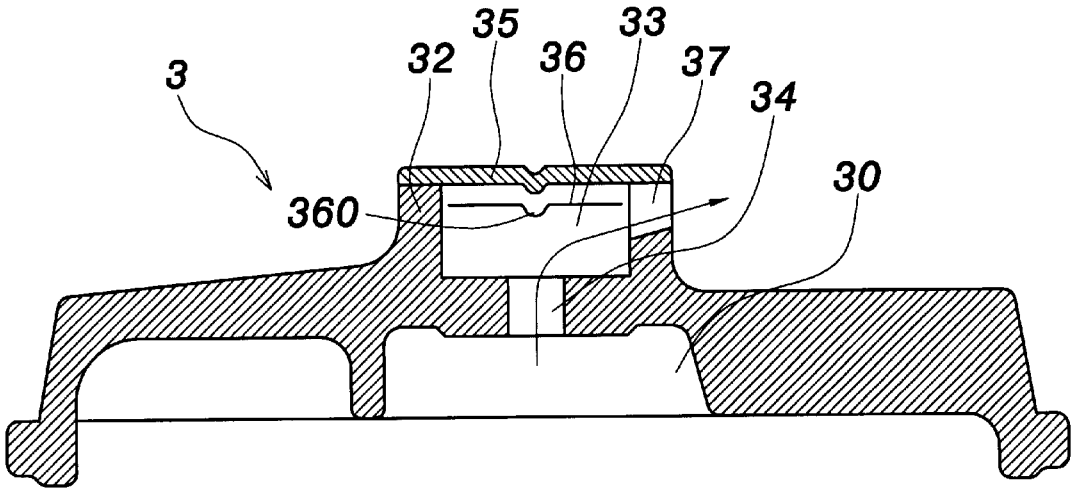
FIG. 3 is a sectional view of a preferred embodiment of the present invention.

With reference now to FIG. 3, the isolation block 3 of the present invention has a projecting ring 32 with a venting passage 33 at center thereof. The venting passage 33 has a through hole 34 on bottom thereof and communicated with the groove 30. A baffle 35 is provided at top opening of the venting passage 33, whereby the venting passage 33 forms a muffle room for the air entering therein. The muffle room has a floating planar valve 36 with a rounded bump at center thereof and projecting toward the fixed scroll member 1. The valve 36 covers the through hole 34 of the venting passage 33 to prevent the reflex of the air in the high-pressure chamber 42. Moreover, the projecting ring 32 has a plurality of venting apertures 37 of window shape on top portion thereof and with even distribution. The plurality of venting apertures 37 can be formed by milling machine or integrally formed with the isolation block 3. Moreover, the venting apertures 37 can be of rounded shape or rectangular shape.

Figure 4:
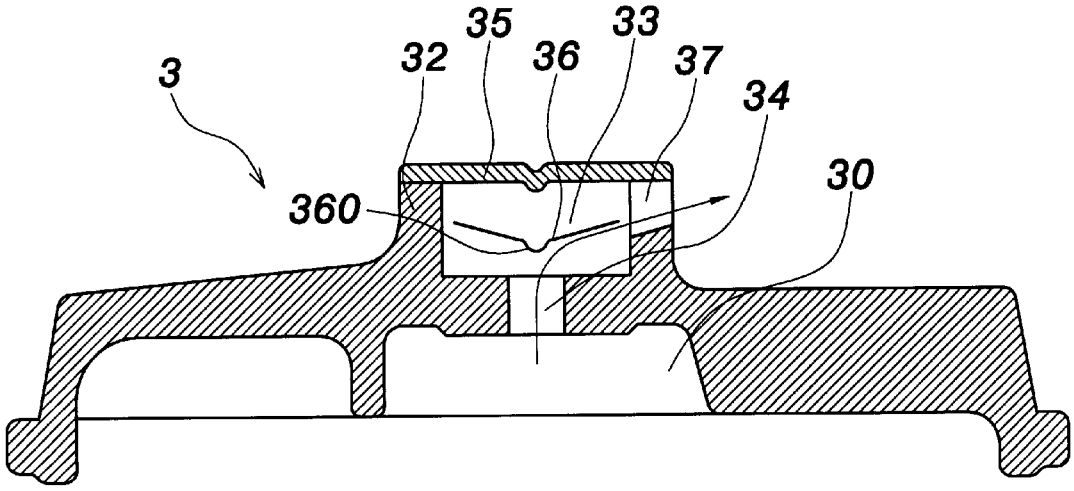
FIG. 4 is a sectional view of another preferred embodiment of the present invention.
Figure 5:
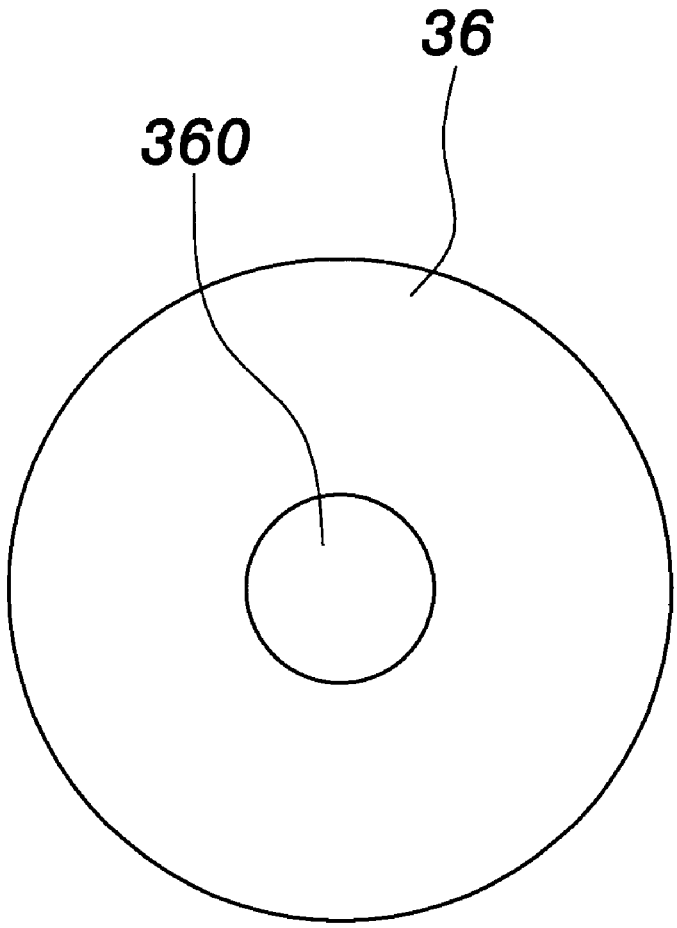
FIG. 5 is top view of the valve of the present invention.

With reference now to FIGS. 4 and 5, to provide better performance for the muffle room and the valve 36, the valve 36 is adapted to cone shape. The flowing resistance and noise are reduced.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A scroll compressor apparatus comprising:

(a) a fixed scroll member having first and second portions forming opposing sides thereof, said first portion having a plurality of scroll wraps extending therefrom, said second portion having a tubular neck extending therefrom, said tubular neck defining a discharge port;

(b) an orbit scroll member coupled to said fixed scroll member, said orbit scroll member having a plurality of scroll wraps respectively engaging said scroll wraps of said fixed scroll member to define therebetween a plurality of compression chambers communicating with said discharge port of said fixed scroll member; and, (c) an isolation block disposed adjacent said fixed scroll member, said isolation block having high pressure and low pressure portions forming opposing sides thereof;

(1) said high pressure portion including an axially projecting ring extending about a venting passage and a baffle coupled to said projecting ring to axially enclose said venting passage, said projecting ring having formed therein a plurality of transversely directed venting apertures; and, (2) said low pressure portion defining a groove and a through hole extending to said venting passage therefrom, said groove receiving therein said tubular neck of said fixed scroll member, said through hole communicating with said discharge port of said fixed scroll member, said through hole being less in diametric extent than said venting passage and at least a proximate portion of said discharge port; and, (d) a valve displaceably disposed in said venting passage of said high pressure portion of said isolation block, said valve being displaceable between closed and open positions, said valve in said closed position sealing an axial end of said through hole.

2. The scroll compressor apparatus as recited in claim 1 wherein said valve in substantially planar in contour.

3. The scroll compressor apparatus as recited in claim 1 wherein said valve in substantially conical in contour.

4. The scroll compressor apparatus as recited in claim 1 wherein said valve has formed thereon a rounded central protuberance extending toward said through hole.

5. The scroll compressor apparatus as recited in claim 1 wherein said baffle has formed thereon a rounded central protuberance extending into said venting passage.

* * * * *